US006957559B2

(12) United States Patent
Venäläinen

(10) Patent No.: US 6,957,559 B2
(45) Date of Patent: Oct. 25, 2005

(54) DEVICE FOR STRAIGHTENING OF SURFACE SHEETS OF A VEHICLE

(75) Inventor: Olavi Venäläinen, Kuopio (FI)

(73) Assignee: Autorobot Finland Oy, Kuopio (FI)

( * ) Notice: Subject to any disclaimer, the term of this patent is extended or adjusted under 35 U.S.C. 154(b) by 0 days.

(21) Appl. No.: 10/981,085

(22) Filed: Nov. 3, 2004

(65) Prior Publication Data

US 2005/0076700 A1 Apr. 14, 2005

Related U.S. Application Data

(63) Continuation of application No. PCT/FI03/00383, filed on May 19, 2003.

(30) Foreign Application Priority Data

May 22, 2002 (FI) ..... 20020969

(51) Int. Cl.[7] ..... B21D 1/12
(52) U.S. Cl. ..... 72/447; 72/705
(58) Field of Search ..... 72/447, 457, 458, 72/705

(56) References Cited

U.S. PATENT DOCUMENTS

| | | | | |
|---|---|---|---|---|
| 3,712,106 A | | 1/1973 | Holsapple et al. | 72/309 |
| 4,026,139 A | | 5/1977 | Glaser et al. | 72/389 |
| 4,930,335 A | * | 6/1990 | Ishihara | 72/451 |

FOREIGN PATENT DOCUMENTS

| | | |
|---|---|---|
| EP | 0 783 926 A1 | 7/1997 |
| EP | 0 856 366 A2 | 8/1998 |
| WO | WO 02/45877 A1 | 6/2002 |

* cited by examiner

*Primary Examiner*—Lowell A. Larson
(74) *Attorney, Agent, or Firm*—Harrington & Smith, LLP

(57) ABSTRACT

The present invention relates to a device for straightening of surface sheets of a vehicle, which device comprises supporting beams (1, 2) mounted at a distance from each other on surface sheets of a vehicle, a transverse support (3) placed between the supporting beams, which transverse support is placed at a distance from the surface of a vehicle (4) during a straightening operation, a straightening fastener (5) attached to the support, which can be attached to the surface sheet of a vehicle, as well as a transferring device (6) for moving the straightening fastener with respect to the vehicle for straightening a surface sheet. In the device in accordance with the invention the transferring device (6) has been placed in the supporting rests (1, 2).

8 Claims, 2 Drawing Sheets

DEVICE FOR STRAIGHTENING OF SURFACE SHEETS OF A VEHICLE

CROSS REFERENCE TO RELATED APPLICATION

This application is a continuation of International Patent Application No. PCT/FI03/00383 filed May 19, 2003.

The present invention relates to a device for straightening of surface sheets of a vehicle, which device comprises supporting beams mounted at a distance from each other on surface sheets of a vehicle, a transverse support placed between the supporting beams, which transverse support is placed at a distance from the surface of a vehicle during a straightening operation, a straightening fastener which is to be attached to the surface sheet of a vehicle as well as a transferring device for moving the straightening fastener with respect to a vehicle for straightening a surface sheet.

BACKGROUND OF THE INVENTION

In collisions as well as in small crashes or accidents in which a vehicle is involved it is usual that at least surface sheets of the vehicle are damaged, in other words, they become more or less dented. When a vehicle is repaired after a crash or other accident, straightening of surface sheets of the vehicle is one of the working phases. Various tools and tool devices are employed for straightening. One of these kind of tool devices is a straightening device, which is attached/supported on the surface of the car near the damage, on the surface sheet on the damaged area, and usually to the place which is most dent special fasteners are attached, and by means of a straightening device the surface sheet is pulled until it straightens.

In one of presently known device there are supporting beams, a transverse support between the supporting beams and in the middle of the support a permanently fixed straightening fastener and at this point near to the straightening device a transferring device for moving the straightening fastener. The pulling force created in this way is of the same magnitude all the time, and it cannot be varied. In addition, regulation of the device by other means is also difficult.

In a vehicle there are so called strong lines in several places and at those points under surface sheets there is a frame, or there are seam points of surface sheets. These points are remarkably stronger than the surface sheet alone. It would be beneficial, while straightening a vehicle, if the supporting beams could be placed on these strong lines. It is of special importance to place both supporting beams on the surface, which does not yield during the straightening operation.

The purpose of the invention is to provide a device for straightening of surface sheets of a vehicle, which device eliminates the disadvantages connected with present devices. Especially, the purpose of the invention is to provide a device in which it is possible to regulate the employed force. In addition, the purpose of the invention is to provide a device, which is easy to adjust to various positions and various places on surface sheets of a vehicle.

Further, the purpose of the invention is to provide a device, which is versatile and easy to use.

DESCRIPTION OF THE INVENTION

In the device in accordance with the invention the transferring device has been placed in the supporting rests. Thus the transferring device or transferring devices are placed at a distance from the straightening fastener. There are usually two transferring devices such that the force is created differently and it may be directed as desired more versatile than in earlier applications. The pulling force directed to a surface sheet may, if necessary, be organized to affect from various directions.

In an advantageous application of the invention the straightening fastener has been movably adjusted to the support. In this case the position of the straightening fastener may be changed with regard to the supporting rests as desired and the supporting rests my be placed at a desired point, on strong lines, for example, on the body and on the surface sheet of a vehicle, and after that the straightening fastener can be adjusted exactly in the desired place. There is also an advantage that when the straightening fastener has been placed, for example, near the other supporting beam, and by employing the supporting beam on the opposite side and the transferring device adjusted to it for creating the force, a great force is been achieved because the torque arm is long and the torque is great.

In the next advantageous application of the invention at least one of the supporting beams has been movably adjusted to the support. In this kind of application also the supporting beam may be moved smoothly and flexibly with regard to the support and the straightening fastener. Hence the straightening device may be adjusted as desired on the surface sheets and the mutual positions of the supporting beams and straightening fastener may be chosen such that they are suitable for each purpose.

In the next advantageous application of the invention the device comprises two or several straightening fasteners adjustable to the support. By means of one straightening fastener it is possible to effectively straighten only a damage area of certain length/extent. When a dent or a depression in a vehicle is great by means of two or several straightening fastener it is possible to create a pull on a larger area and the straightening work will become easier.

In the next advantageous application of the invention the supporting beams comprise an arm part and a rest part horizontally rotatably attached to it. Since the rest part may rotate horizontally with regard to the arm part, the rest part can be rotated such, that it may be mounted on the surface sheets of a vehicle along so called strong lines. Consequently the rest parts can be placed firmly, and on their whole area, on this kind of line.

In the next additional advantageous application of the invention the rest part has a fastening part and two counter rests which have been adjusted by means of ball joints rotatably to the fastening part. The surface of a vehicle is curved at many points. In that case by means of ball joints the counter rests turn along the surface and are always placed perpendicularly on the surface of a vehicle. In that case they are firmly fastened.

In the next advantageous application of the invention the counter rests of the other supporting beam are equipped with magnetic fasteners and the counter rests of the other supporting beam are equipped with suction cup fasteners. The device for straightening of surface sheets of a vehicle is of relatively great size, but it is meant for one worker to handle and carry out the straightening operation. Since the other counter rests are equipped with magnetic fasteners it is possible to have these rests first exactly at the desired point and be fixed there. After this the support and the other end are possible to be rotated and the straightening fastener and the other supporting beam may be adjusted such that they will be placed at the desired point. After this the counter rests of the other supporting beam are placed in their place such that they will be fastened on the surface sheets of the vehicle by means of a suction cup system.

In the next advantageous application of the invention the device includes a removably mountable extension part for the support end. The extension part may be attached to the end of the support such that it creates a continuous long support. In this case the device may be employed for straightening of large damages. These kind of damages occur, for example, on sides of vans and other large vehicles and the straightening of those damages has been difficult by means of present devices.

DESCRIPTION OF THE DRAWINGS

Next, the invention will be explained in more detail with reference to the accompanying drawings, in which.

Figure 1:
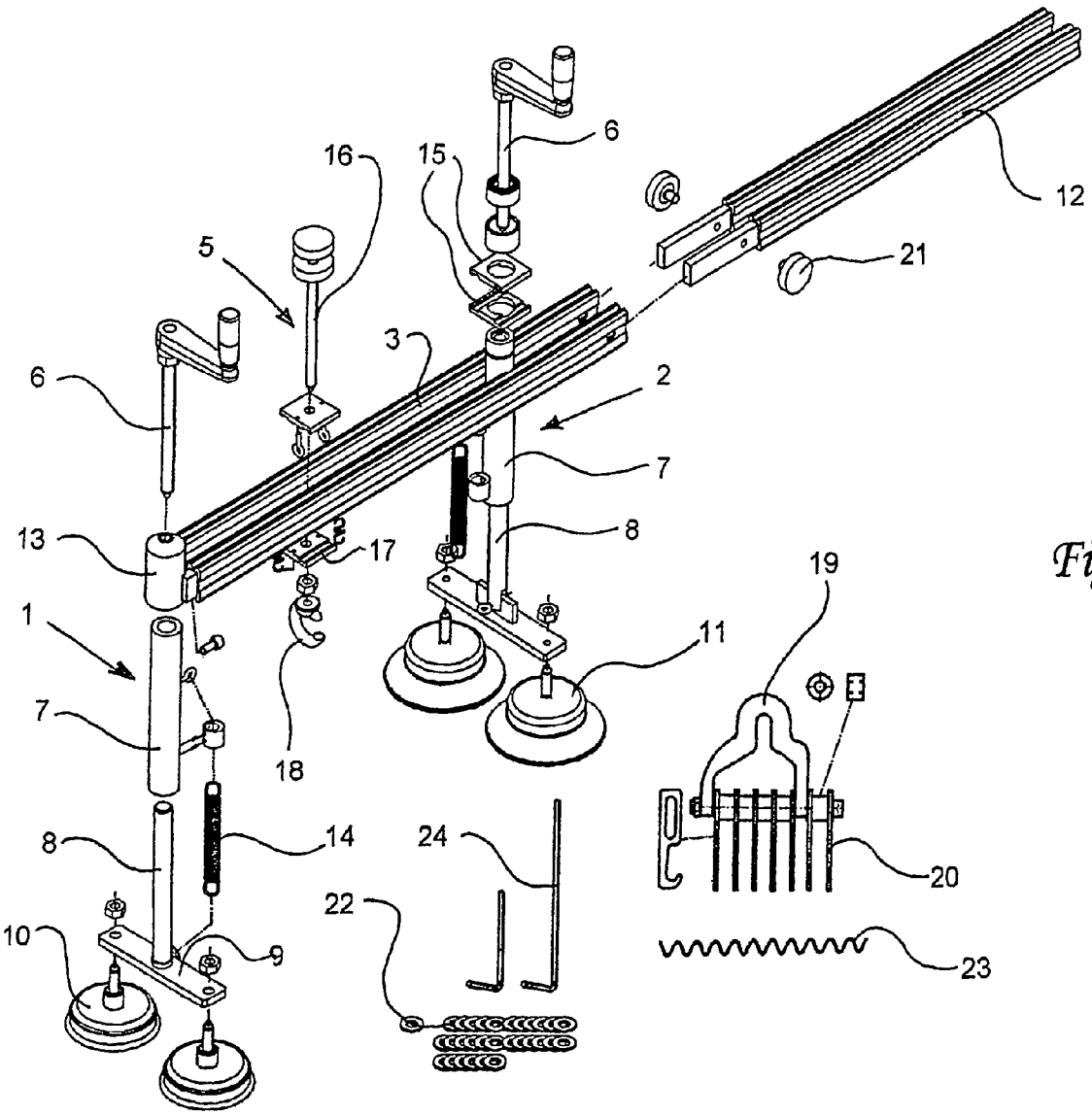
FIG. 1 illustrates an application of a device in accordance with the invention as an exploded view viewed from side.

The device in accordance with FIG. 1 comprises supporting beams 1 and 2, a support 3, a straightening fastener 5 and transferring devices 6. The transverse support 3 has, in this application, been formed of two mainly parallel supports, which are hollow metal profiles. The supporting beam 1 has been adjusted to the ends of these arms by means of the separate end element 13, which has end supports reaching inside the hollow support parts.

The supporting beams comprise an arm part 7 and an inner tube partly placed inside it, which inner tube forms the upper part of the rest part 8. In addition, in the rest part there is the fastening part 9, traverse with regard to the inner tube attached to it, which fastening part includes pivotlike parts with two counter rests 10, 11 attached to them. The counter rests have been attached by means of ball joints to the pivotlike parts. The supporting beams 1 and 2 comprise, in addition, a spring element 14, attached to the tube and the rest part, which spring part has been organized to rotate the rest part to its initial position, but which allows the movement of the rest part with regard to the tube. The rest parts 10 of the other supporting beam 1 have been equipped with magnetic fasteners and the other rest parts 11 of the other supporting beam 2 have been equipped with suction cup fasteners.

A torque lever or the like is functioning as a transferring device 6, which has been organized to reach inside the tubular arm part 7 and, if necessary, the upper part of the rest part 8. The lower part of the lever has been threaded and the inner parts of the other parts have been equipped with corresponding threads. Therefore, the transferring device is employed by rotating the lever to desired direction.

The other supporting beam 2 has been removably and movably attached to the traverse support 3 and, in this application, it has been attached between the parts of the support to the upper edge and the lower edge of the parts by means of clamps 15.

The device comprises, in addition, a straightening fastener 5, which includes a fastening bolt 16, tension plates 17 and a pulling element 18, which is, in this application, a pull strap. The straightening fastener may be fastened to the desired point of the support by means of the tension plates. The height of the pulling element from the surface of the vehicle may be regulated by means of the fastening bolt. In addition, the device comprises a grabbing element 19 with clasp-like lifting elements 20 to be attached to the pull strap. In the figure there are base plates 22 and a pulling thread 23 presented. The base plates or the pulling thread are attached in the beginning of the work by welding to the point to be straightened on the surface of the sheet either base plates at a distance from one another or the loop of the pulling thread from its lower edges. The clasp-like lifting elements 20 of the grabbing element 19 are placed, while lifting, either to the loops of the pulling thread or attached to the bar 24 placed through the base plates. The base plates and the pulling thread are alternative in use.

In FIG. 1 there is the extension part 12 of the support presented, which extension part is attachable to the end of the actual support by means of the fastening elements 21 to the openings in the end of the support, and by means of which the length of the support may be increased. The ends of the extension parts are guided to go inside the actual support parts and by means of the fastening parts they are fixed firmly in place. The straightening fastener may also be attached to the desired point either at the point of the actual support or at the point of the extension part.

Figure 2:
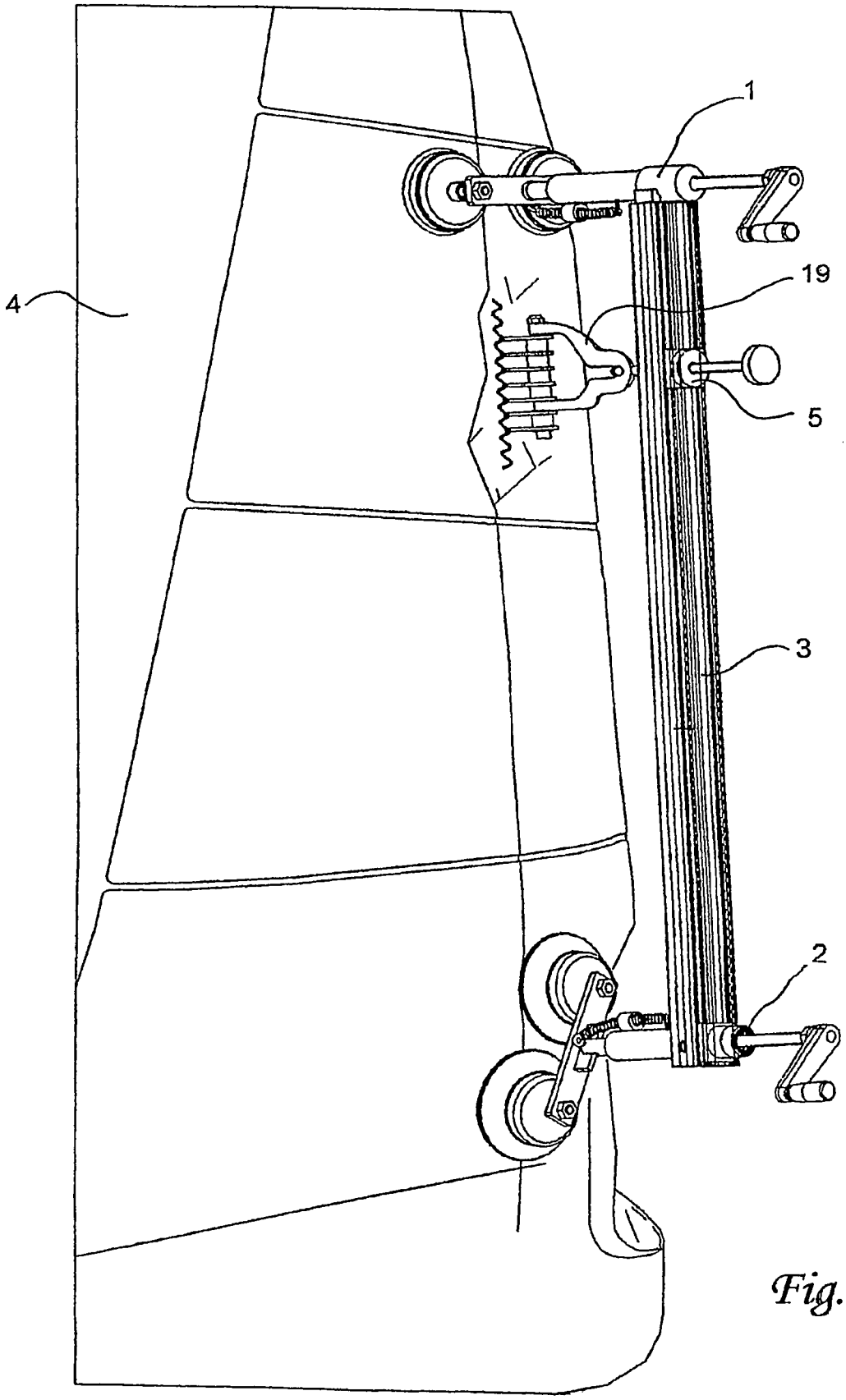
FIG. 2 illustrates the straightening of surface sheets with the device in accordance with the invention viewed inclined from side.

In FIG. 2 there is the power actuator of the device in accordance with the invention presented in a straightening process. Before starting the work, either base plates are welded, in a recognized way itself, at a distance from one another or a pulling thread at the point of the dent. After this the device in accordance with the invention is adjusted such that the supporting beams 1 and 2 are placed on so called strong areas of the surface sheets of the vehicle. In the application in accordance with the figure the first supporting rest 1 equipped with magnetic fasteners has been placed on the surface sheets of the vehicle such that the counter rests are mainly perpendicularly with regard to the support 3. After this, the other supporting beam 2 has been adjusted on the other so-called strong line such that the counter rests are placed at an angle with regard to the support. In the next phase the straightening fastener 5 is moved to the point of the dent, and its grabbing element is placed such that the clasp-like lifting elements are around the bar of the base plates or in the loops of the tread of the tread puller. The straightening fastener is fastened with a bolt to the position in accordance with FIG. 2 and the surface sheet of the vehicle is straightened by employing transferring devices. In the application in accordance with FIG. 2 the other transferring device 2 is remarkable further from the straightening point than the first transferring device 1, such that by using this transferring device a relatively great force and torque are achieved. This way a surface sheet of a vehicle may be straightened quickly and efficiently:

The invention is not limited to the presented advantageous application but it can vary within the frames of the idea of the invention formed in the claims.

What is claimed is:

1. A device for straightening of a surface sheet of a vehicle, which includes supporting beams adapted to be mounted on the vehicle at a distance from one another, a traverse support placed between the supporting beams, which support is adapted to be placed at a distance from the surface sheet of the vehicle during a straightening operation, a straightening fastener attached to the support, wherein said straightening fastener is attachable to the surface sheet of the vehicle, a transferring device adapted for moving the straightening fastener with regard to the vehicle for straightening of the surface sheet, wherein said transferring device is connected to supporting rests adapted to be located on the vehicle.

2. A device according to claim 1, in which the straightening fastener is movably attached to the support.

3. A device according to claim 1, in which at least one of the supporting beams is movably attached to the support.

4. A device according to claim 1, in which the device comprises at least two straightening fasteners attached to the support.

5. A device according to claim 1, in which the supporting beams comprise an arm part and a rest part horizontally rotatably attached to the arm part.

6. A device according to claim 5, in which in the rest part there is a fastening part and the supporting rests are connected to the fastening part, wherein the supporting rests comprise two counter rests, which have been rotatably attached by means of a ball joint to the fastening part.

7. A device according to claim 6, in which the counter rests of a first one of the supporting beams have been equipped with magnetic fasteners and the counter rests of a second one of the supporting beams have been equipped with suction cup fasteners.

8. A device according to claim 1, in which the device comprises an extension part removably attached to an end of the support.

* * * * *